US012312059B2

(12) United States Patent
Stanley et al.

(10) Patent No.: US 12,312,059 B2
(45) Date of Patent: May 27, 2025

(54) OUTBOARD MOTOR TRANSMISSION WITH COAXIAL INPUT AND OUTPUT SHAFTS

(71) Applicants: ZF Marine Propulsion Systems Miramar, LLC, Miramar, FL (US); ZF Padova S.r.l., Casselle di Selvazzano (IT); Gator Tail LLC, Loreauville, LA (US)

(72) Inventors: Keith Stanley, Coral Springs, FL (US); Drew Orvieto, Plantation, FL (US); David Friedenberg, Plantation, FL (US); Andrea Pellegrinetti, Malcesine (IT); Mattia Caracristi, Isera (IT); Michele Zottele, Trento (IT); Kyle Broussard, New Iberia, LA (US); Blaine Broussard, Loreauville, LA (US)

(73) Assignees: ZF Marine Propulsion Systems Miramar, LLC, Miramar, FL (US); ZF Padova S.r.l., Casselle di Selvazzano (IT); Gator Tail LLC, Loreauville, LA (US)

( * ) Notice: Subject to any disclaimer, the term of this patent is extended or adjusted under 35 U.S.C. 154(b) by 473 days.

(21) Appl. No.: 17/828,502

(22) Filed: May 31, 2022

(65) Prior Publication Data

US 2023/0382509 A1 Nov. 30, 2023

(51) Int. Cl.
*B63H 20/20* (2006.01)
*B63H 20/32* (2006.01)

(52) U.S. Cl.
CPC ..... *B63H 20/20* (2013.01); *B63H 2020/323* (2013.01)

(58) Field of Classification Search
CPC ..... B63H 20/20; B63H 2020/323
See application file for complete search history.

(56) References Cited

U.S. PATENT DOCUMENTS 4,792,315 A 12/1988 Karrasch et al.
5,421,755 A * 6/1995 Kakizaki ..... B63H 21/213 440/86

(Continued)

FOREIGN PATENT DOCUMENTS

EP 3 168 134 B1 9/2018

OTHER PUBLICATIONS

Weberauto, Chevrolet Bolt EV Traction Motor—Deep Dive, https://www.youtube.com/watch?v=APhRPSdmdmk (Uploaded Dec. 17, 2018).

(Continued)

*Primary Examiner* — Stephen P Avila
(74) *Attorney, Agent, or Firm* — Finch & Maloney PLLC

(57) ABSTRACT

A gearcase for a marine propulsion system has an input shaft rotatable about a central axis of rotation and an output shaft coaxially arranged with the input shaft. A clutch assembly is operable between a first clutch position and a second clutch position, wherein, when the clutch assembly is in the first clutch position, the input shaft is coupled to the output shaft for rotating the output shaft in a first rotational direction. When the clutch assembly is in the second clutch position a gear assembly operably connects the input shaft to the output shaft for rotating the output shaft in an opposite second rotational direction. The gearcase can be part of a marine propulsion system, such as an outboard motor for a mud boat. A method of transferring power in a gearcase and a marine propulsion system are also disclosed.

20 Claims, 6 Drawing Sheets

(56) References Cited

U.S. PATENT DOCUMENTS

| | | | | |
|---|---|---|---|---|
| 7,048,600 | B1 | 5/2006 | Broussard | |
| 9,676,463 | B1 | 6/2017 | Fortl et al. | |
| 2006/0199451 | A1 | 9/2006 | Broussard | |
| 2007/0123119 | A1 | 5/2007 | Provost | |
| 2015/0353177 | A1* | 12/2015 | Flodman ..... | B63H 20/20 440/75 |

OTHER PUBLICATIONS

Robus, Robus In-Line Helical Gearboxes by Motive, https://www.youtube.com/watch?v =-5Givjw5NCg, (Jul. 18, 2013).
Sogears Manufacturing, Good Quality Coaxial Gear Motor and Coaxial Helical Gear Units, www.sogears.com (Visited May 31, 2022).
ZF Group, Products of Great Value Planetary Gearboxes for Servomotors ZF Servoplan (Oct. 2021).

* cited by examiner

OUTBOARD MOTOR TRANSMISSION WITH COAXIAL INPUT AND OUTPUT SHAFTS

TECHNICAL FIELD

The present disclosure relates to marine propulsion systems and more specifically to a gearcase having an input shaft and output shaft on the same axis.

BACKGROUND

Small marine craft that operate primarily in shallow water are often referred to as mud boats. Some mud boats are shallow draft, flat bottom boats powered by an air-cooled inboard engine that is connected to an outboard drive extending through the hull or transom. Other mud boats are powered by an outboard motor attached to the boat's transom and controlled either using remote steering and drive controls or via a tiller handle, for example.

An outboard boat motor commonly has a power head with an engine, a leg extending vertically down from the power head, and a skeg with a propeller. A drive shaft extends through the leg to drive the propeller using a beveled pinion gear. In such embodiments, the propeller is below the bottom of the boat hull and is intended to operate in open water at least a few feet deep. At speed, shallow draft boats are known to create a depression for some distance directly behind the transom. For this reason, it is important that the propeller shaft extend below the hull to make sufficient contact with the water, to provide thrust, and to prevent cavitation.

In contrast, motors for mud boats typically are designed so that the propeller is just below the water line and the drive does not extend below the bottom of the hull. Mud boats rely a great deal on propeller contact with the mud and the propeller's ability to cut the vegetation to help drive the boat. For this reason, an accepted mud boat design includes an elongated drive shaft that extends at a shallow angle from above a boat's transom to just below the water surface.

SUMMARY

The present disclosure is directed to a gearcase with coaxial input and output shafts. The gearcase can be part of a marine propulsion system, such as an outboard boat motor configured for a mud boat or other boat. Similarly, the gearcase can be part of a stern-drive or inboard marine propulsion system. In yet other embodiments, the gearcase can be part of an automotive or motorbike drive system, whether with a combustion engine or electric motor.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
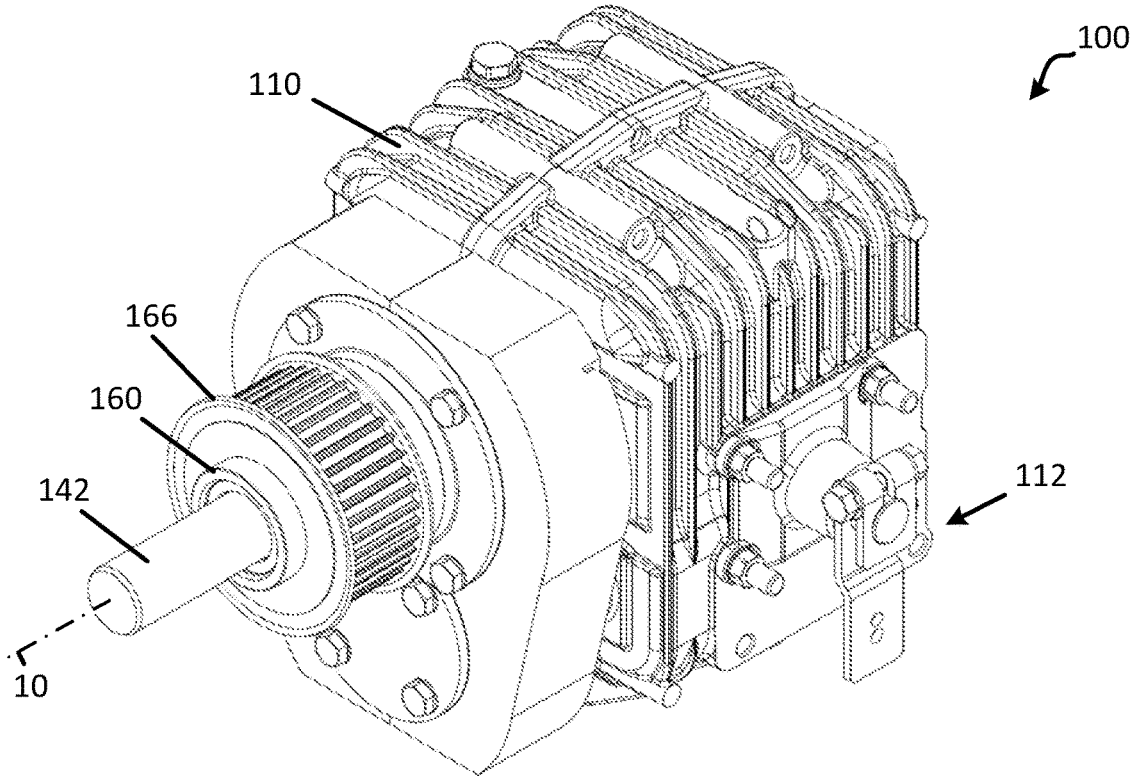
FIG. 1 is a perspective view of a gearcase, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a gearcase with an input shaft coaxially arranged with an output shaft. In one example embodiment configured for an outboard motor for a mud boat, the input shaft extends through an end of the gearcase housing to connect to an engine for the purpose of driving the input shaft. For example, the engine is a two-cylinder engine of 50-90 hp. Part of the output shaft is outside the housing and includes a pulley. For example, the pulley is between the engine and the gearcase housing. A drive belt, such as a synchronous belt made of polymeric material, can be used with the pulley to drive a propeller shaft.

The gearcase includes a first clutch and a second clutch. When the first clutch is engaged, the input shaft is united with the output shaft for rotation in a first rotational direction (e.g., forward). While the first clutch is engaged other gears in the gearcase may rotate without loads. When the second clutch is engaged, a gear on the input shaft turns an idle shaft via an idle gear. The idle shaft engages another gear which in turn dives the output shaft in a second rotational direction (e.g., reverse).

Due to the input shaft being coaxially arranged with the output shaft, the size of the pulley is not limited by a parallel shaft on the exterior of the housing. Accordingly, the pulley advantageously can be exchanged with a pulley of different size as deemed appropriate for a particular application. Such arrangement also provides flexibility, for example, in selecting the motor or engine used with the gearcase. Accordingly, the gearcase can have a gear ratio of 1.0 in both forward and reverse directions, where torque and drive speed can be determined at least in part by pulley selection.

Overview

Existing outboard motors for mud boats have an input shaft arranged in parallel with the output shaft. For example, the output shaft is positioned below the input shaft, where portions of both the input shaft and output shaft extend through the gearcase housing. Due to the spacing between the input and output shafts, the pulley size is limited. Additionally, such arrangement limits the ability to exchange the pulley or engine for different applications. Therefore, a need exists for improvements to propulsion systems.

The present disclosure addresses this need and others by providing a gearcase with an input shaft that is coaxially arranged with the output shaft. The gearcase can be used as part of a marine propulsion system, for automotive uses, or in a dirt bike, for example. Numerous variations and embodiments will be apparent in light of the present disclosure.

It should be noted that, while generally referred to herein as a gearcase for consistency and ease of understanding the present disclosure, the disclosed gearcase is not limited to that specific terminology and alternatively can be referred to, for example, as a gear box, a transmission assembly, or other terms.

Example Embodiments

Figure 2:
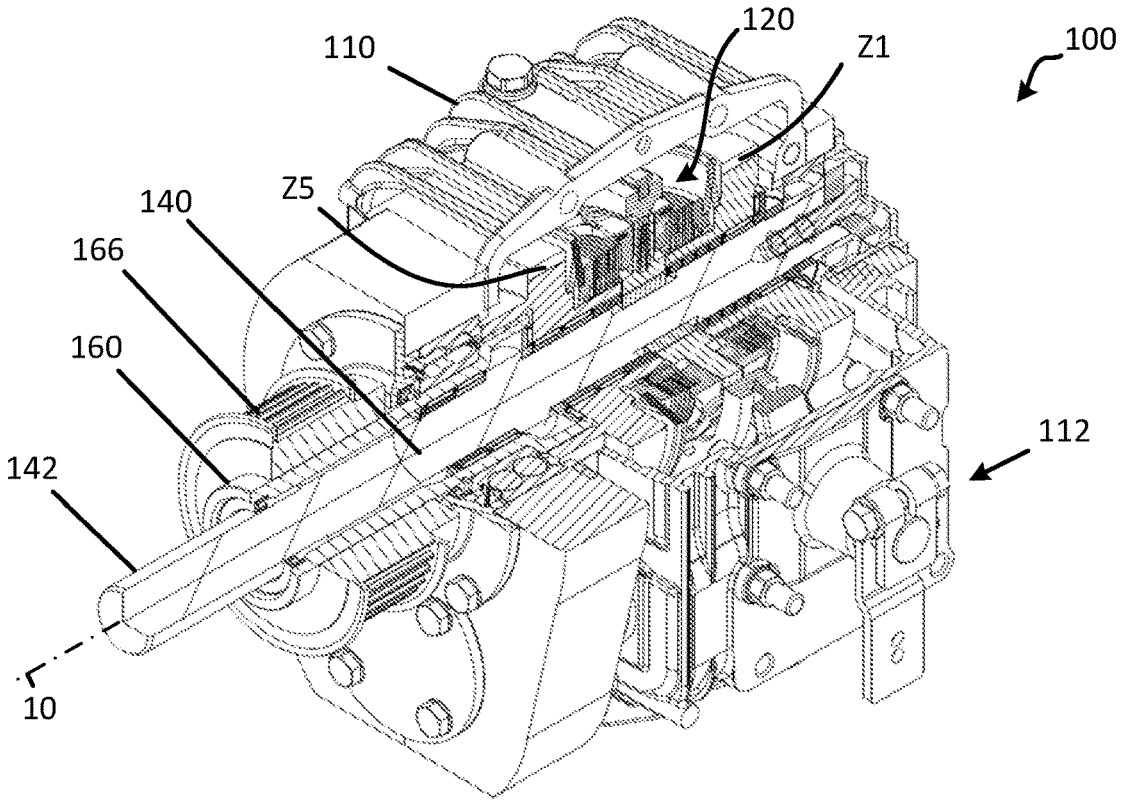
FIG. 2 is a quarter section of the gearcase shown in FIG. 1

FIG. 1 illustrates a top, side, and rear perspective view showing a gearcase 100, in accordance with an embodiment of the present disclosure. FIG. 2 illustrates a ¼ section of the gearcase 100 of FIG. 1 and shows components within the housing 110. On a side of the housing 110 is a clutch actuator 112 configured to operate a clutch assembly 120. For example, the clutch actuator 112 can be attached to a control cable (also referred to as a Bowden cable) to move the clutch actuator 112 between a forward position, a neutral or idle position, and a reverse position. Although the clutch 120 is shown in this example as having mechanical actuation, in other embodiments the clutch 120 can be actuated with a hydraulic circuit. In one embodiment, the clutch assembly 120 includes a first clutch 120*a* and a second clutch 120*b*, each having a clutch pack arranged on opposite sides of the clutch actuator 112. Moving the clutch actuator 112 to engage the first clutch 120*a* unites the input shaft 140 with the output shaft 160. Moving the clutch actuator 112 to engage the second clutch 120*b* drives the idle shaft, which in turn rotates the output shaft 160 in an opposite rotational direction.

Figure 7:
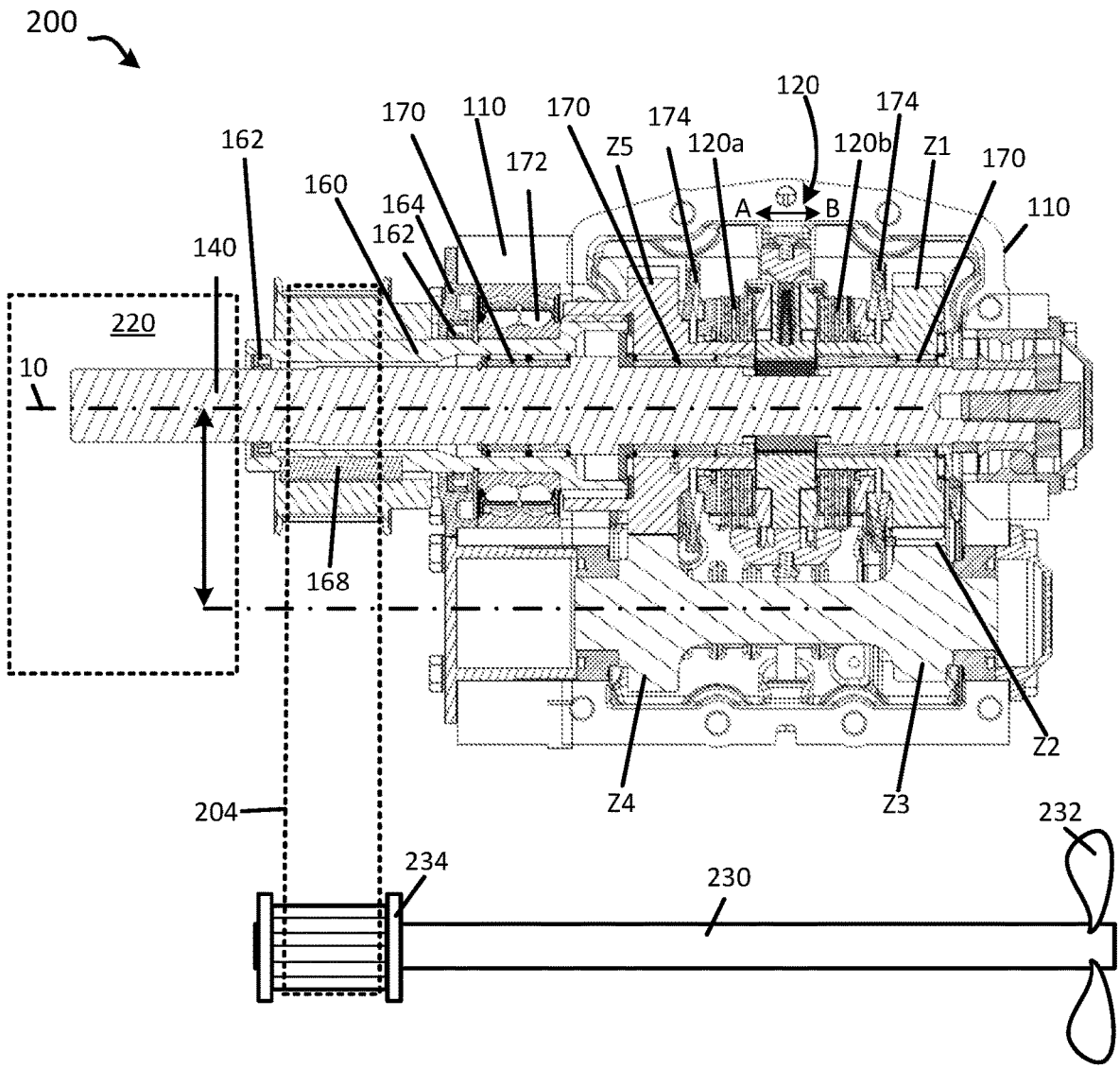
FIG. 7 is a side view of a marine propulsion system and shows the gearcase in cross-section, in accordance with an embodiment of the present disclosure.

An input shaft 140 extends through the gearcase 100 and has a drive portion 142 exposed outside of the housing 110 for connection to an engine 220 or motor (shown in FIG. 7). The output shaft 160 is coaxially arranged with the input shaft 140 such that the input shaft 140 extends through the output shaft 160 along a central axis of rotation 10. A pulley 166 is on the output shaft 160 and rotates with the output shaft 160 with a 1:1 ratio.

Figure 3:
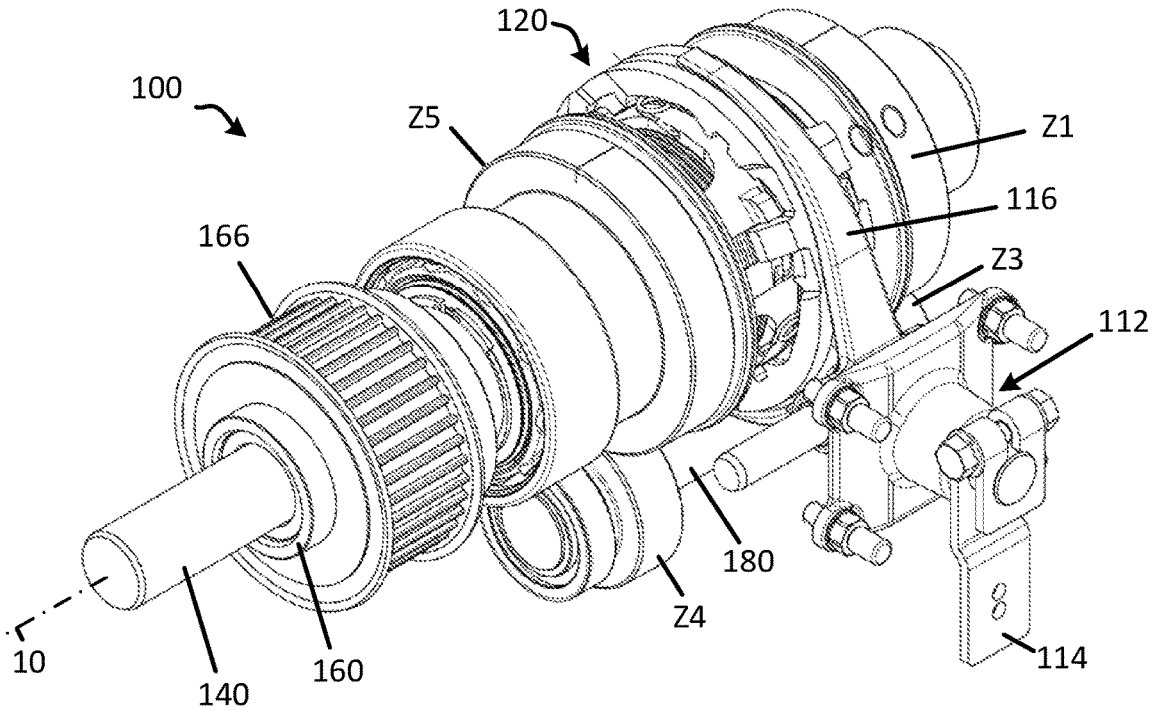
FIG. 3 illustrates a perspective view of components within the housing of the gearcase of FIG. 1.
Figure 4:
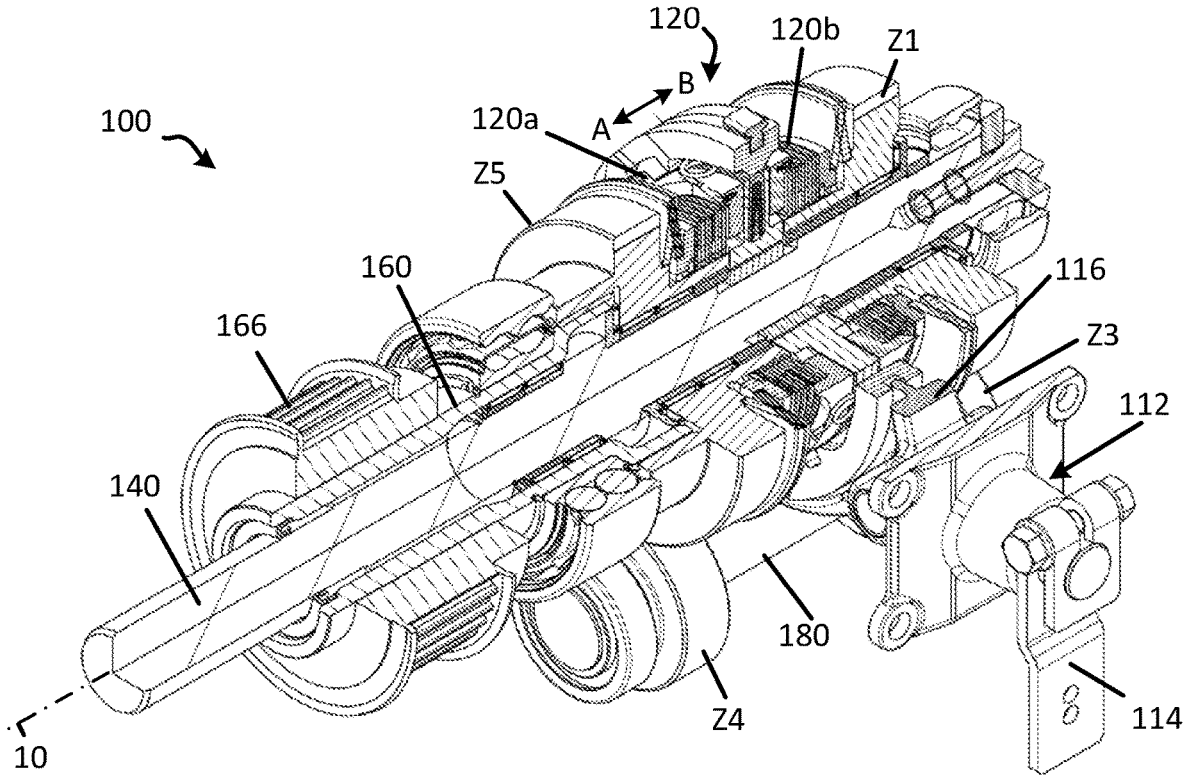
FIG. 4 is a quarter section of the components shown in FIG. 3.
Figure 5:
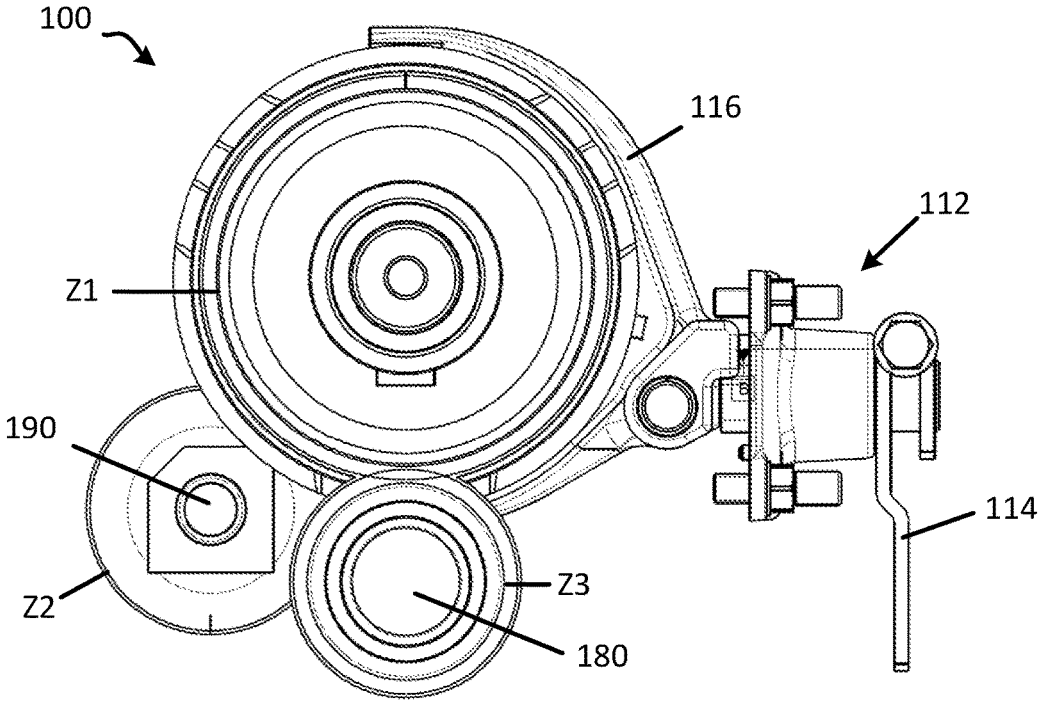
FIG. 5 is an end view of the input shaft, first idle shaft, and second shaft of a gearcase, in accordance with an embodiment of the present disclosure.
Figure 6:
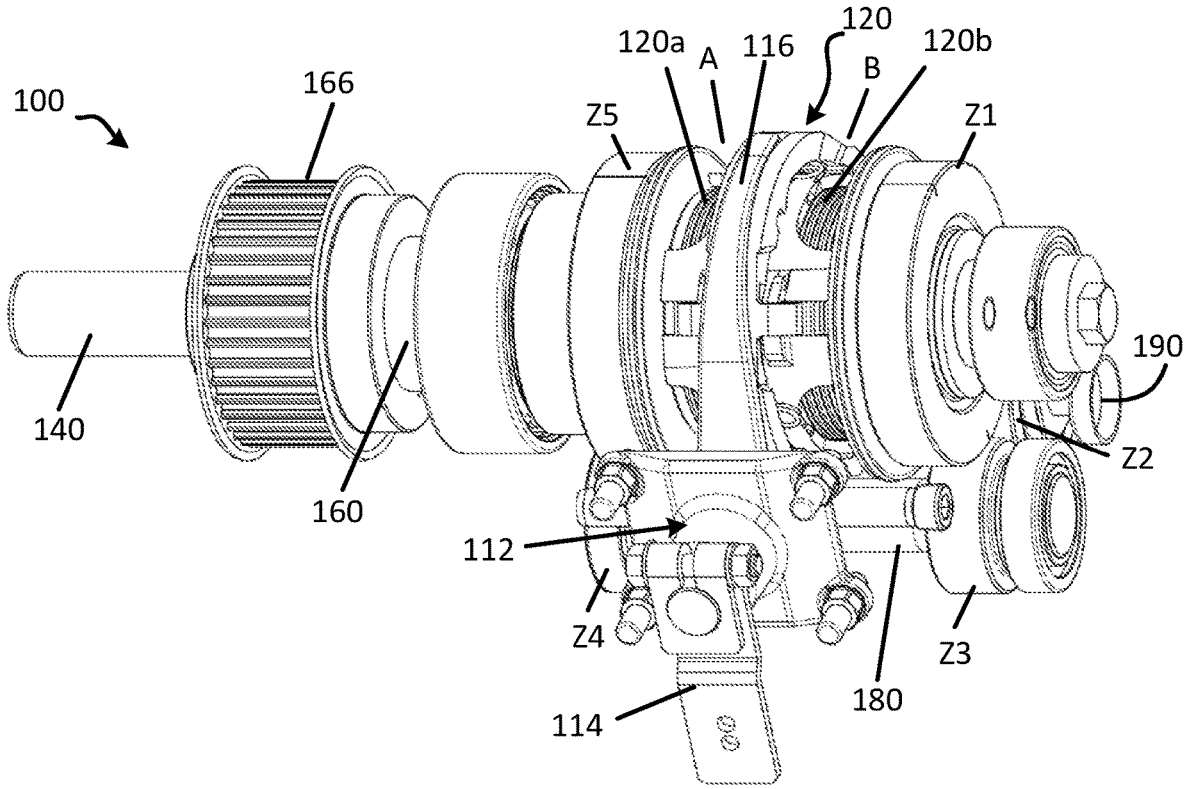
FIG. 6 is a perspective view of the components shown in FIG. 5.

FIGS. 3 and 4 illustrate top, side, and rear perspective view of the gearcase 100 with the housing 110 omitted for clarity. FIG. 4 is a ¼-sectional view of the gearcase 100 of FIG. 3. FIG. 5 illustrates a rear-end view of the gearcase 100 and FIG. 6 illustrates a side perspective view of the gearcase 100. The gearcase 100 includes input shaft 140 and output shaft 160 as discussed above. The gearcase 100 includes a first gear Z1 and a fifth gear Z5 concentrically arranged around the input shaft 140. In this example, the first gear Z1 fifth gear Z5 are positioned within housing 110 (shown in FIG. 2) on opposite sides of the clutch assembly 120 and rotate around the axis of rotation 10. An idle shaft 180 is below and extends parallel to the input shaft 140. In one example, the idle shaft 180 is vertically aligned with the input shaft 140. The idle shaft 180 includes a third gear Z3 on a first portion of the idle shaft 180, such as on a first end or first end portion. A fourth gear Z4 is on a second portion of the idle shaft 180, such as a second end or second end portion. In some embodiments, the third gear Z3 and/or the fourth gear Z4 are integrally formed as part of the idle shaft 180, but this is not required in all embodiments. The third gear Z3 and fourth gear Z4 can have the same gear configuration (e.g., diameter, number of teeth), but this is not required.

The clutch actuator 112 includes a lever or handle 114 that rotates to move a clutch bracket 116 axially along the gearcase 100 to position A to engage the first clutch 120*a*, or position B to engage the second clutch 120*b*. In either position A or position B, pressure is applied to friction elements and springs in the clutch pack to engage the respective clutch 120*a*, 120*b*. As can be seen in FIG. 5, for example, a clutch bracket 116 extends about 180° around the clutch assembly 120. When the clutch actuator 112 is in the first clutch position A, the input shaft 140 is united with the output shaft 160. Accordingly, when the input shaft 140 turns, the output shaft 160 turns with the input shaft in the first rotational direction with a 1:1 ratio. Clutch position A may be referred to as a forward drive position. In this forward drive position, gears Z1-Z5 may rotate without loads or with a negligible load. When the clutch actuator 112 is moved to the second clutch position B to engage the second clutch 120*b*, the output shaft 160 is no longer united with the input shaft 140 and the input shaft 140 engages and rotates the first gear Z1.

The first gear Z1 is operationally connected to an idle shaft 180 by an idle gear or second gear Z2, which is positioned below and to the side of the input shaft 140 in this example. The second gear Z2 rotates about an idle gear shaft 190 that is offset from the central axis of rotation 10. The idle shaft 180 includes a third gear Z3 on a first end portion and a fourth gear Z4 on an opposite second end portion. The first gear Z1 engages the second gear Z2, which engages the third gear Z3 on the idle shaft 180. Thus, with the second clutch 120*b* engaged, rotating the input shaft 140 in the first rotational direction turns the first gear Z1 in the first rotational direction, which drives the second gear Z2 in a second rotational direction. The second gear Z2 in turn drives the idle shaft 180 by engaging the third gear Z3, turning the idle shaft 180 and fourth gear Z4. The fourth gear Z4 engages the fifth gear Z5, which drives the output shaft 160 in the second rotational direction.

Teeth of gears Z1-Z5 are not illustrated in the figures; however, it is to be understood that each of gears Z1-Z5 defines teeth (or "splines") configured to mesh with or engage teeth of another gear for the purpose of transferring torque from one gear to another. In some embodiments, the teeth are arranged parallel to the axis of rotation of the respective gear. In other embodiments, the teeth can be helically arranged. The number of teeth, pitch, depth, width, and orientation, among other factors, can be configured as needed for a particular use. Numerous variations and embodiments will be apparent in light of the present disclosure.

Referring now to FIG. 7, a side cross-sectional view illustrates gearcase 100 and additional components of a marine propulsion system 200, in accordance with an embodiment of the present disclosure. The marine propulsion system 200 is configured as an outboard motor for a mud boat. The propulsion system 200 includes the gearcase 100 shown in FIGS. 1-6, which has an input shaft 140 that is coaxially arranged with the output shaft 160. On a proximal end of the propulsion system 200, the input shaft 140 is driven by an electric motor or combustion engine 220. For example, the engine can be a two-cylinder combustion engine operating on gasoline, diesel fuel, or a mixture of gasoline and oil. In one embodiment, the engine is a 2-stroke gasoline engine that operates with a 50:1 ratio of gasoline to oil. For example, the engine is a 2-stroke gasoline engine from 70-90 horsepower (hp) and providing torque of 175 Nm at 6500 rpm. In other embodiments, the engine is a 4-stroke gasoline engine, which may be preferred in for applications better suited with greater low-speed torque. In yet other embodiments, an electric motor can be used to drive the input shaft 140.

The pulley 166 is coupled to the output shaft 160 via a key 168. In other embodiments, the pulley 166 is mounted to the output shaft 160 using a splined engagement, fixedly attached to the output shaft 160 using fasteners, or utilizes a non-cylindrical shape (e.g., a flat on the output shaft 160 or part of the output shaft 160 having a square shape). A drive belt 204 connects the pulley 166 to a propeller shaft 230 and drives the propeller shaft 230 and propeller 232. The drive belt 204 can be synchronous belt with an endless or spliced construction, a V-belt, or other drive belt 204 made of rubber, polymers, reinforced polymer, or other suitable material. In other embodiments, a chain can be used between the pulley 166 and propeller shaft 230 to drive the propeller 232. In some embodiments, the propeller shaft 230 includes a propeller shaft pulley 234 sized and configured to provide the desired output for the propeller 232.

A fluid seal 162 is between the proximal end of the output shaft 160 and the drive portion 142 of the input shaft 140. A fluid seal 162 is also between a damper plate 164 and the output shaft 160. A roller bearing 170, such as a needle roller bearing, is between the input shaft 140 and the output shaft 160. A roller bearing 172, such as a double roller bearing, is between the output shaft 160 and the housing 110. Roller bearings 170, such as needle bearing, are between the input shaft 140 and the fifth gear Z5 as well as between the input shaft 140 and the first gear Z1. A clutch spring 174 is between the first clutch A and the fifth gear Z5 and a clutch spring 174 is between the second clutch B and the first gear Z1. The clutch spring 174 can be a cap spring, a diaphragm spring, or other suitable clutch spring. As the clutch actuator 112 moves to clutch position A or clutch position B, the respective clutch spring 174 is compressed.

Figure 8:
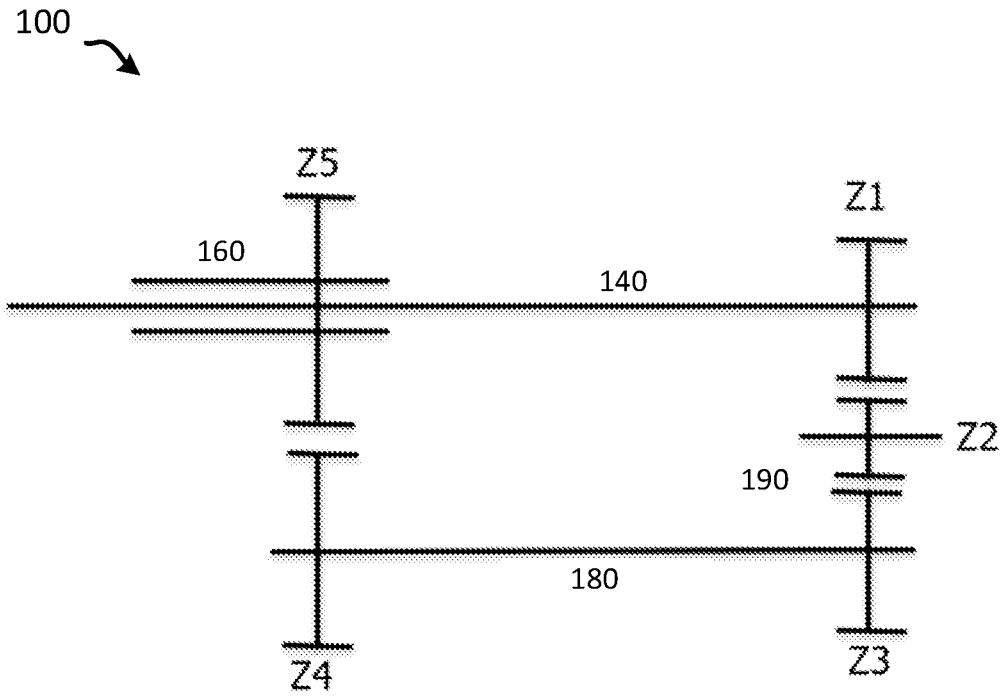
FIG. 8 illustrates a schematic representation of gears of a gearcase with coaxial input and output shafts, in accordance with an embodiment of the present disclosure.

FIG. 8 illustrates a schematic diagram of gears in the gearcase 100. As noted above, the input shaft 140 is coaxially arranged with the output shaft 160. When the clutch assembly 120 is in a first position (position A) the input shaft 140 is united with the output shaft 160. When the clutch assembly 120 is in the second position (position B), the first gear Z1 is engaged, rotating the second gear Z2 about the idle gear shaft 190, which turns the idle shaft 180 with the third gear Z3 and fourth gear Z4. The fourth gear Z4 engages the fifth gear Z5 to drive the output shaft 160.

In one embodiment, the idle shaft 180 and input shaft 140 have an inter-axis distance of 70-100 mm, including 80-90 mm or about 85 mm. The first gear Z1 has 44 teeth, second gear Z2 has 27 teeth, third gear Z3 has 21 teeth, fourth gear Z4 has 24 teeth, and fifth gear Z5 has 40 teeth. In such embodiment, the gear ratio between the first and second gears Z1, Z2 is 0.61, the gear ratio between second and third gears Z2, Z3 is 0.78, and the gear ratio between fourth gear Z4 and fifth gear Z5 is 2.04. In this configuration, the gear ratio for forward operation and for reverse operation is 1.0. Other gear ratios can be used as deemed appropriate for a particular application.

Due to the coaxial arrangement of the input and output shafts, the pulley 166 can be changed and/or the engine 220 can be changed to adjust propeller speed, torque, or other performance parameters. In comparison to other gearboxes having the input shaft parallel to the output shaft, the ability to change the pulley is limited by spacing between the parallel shafts.

Figure 9:
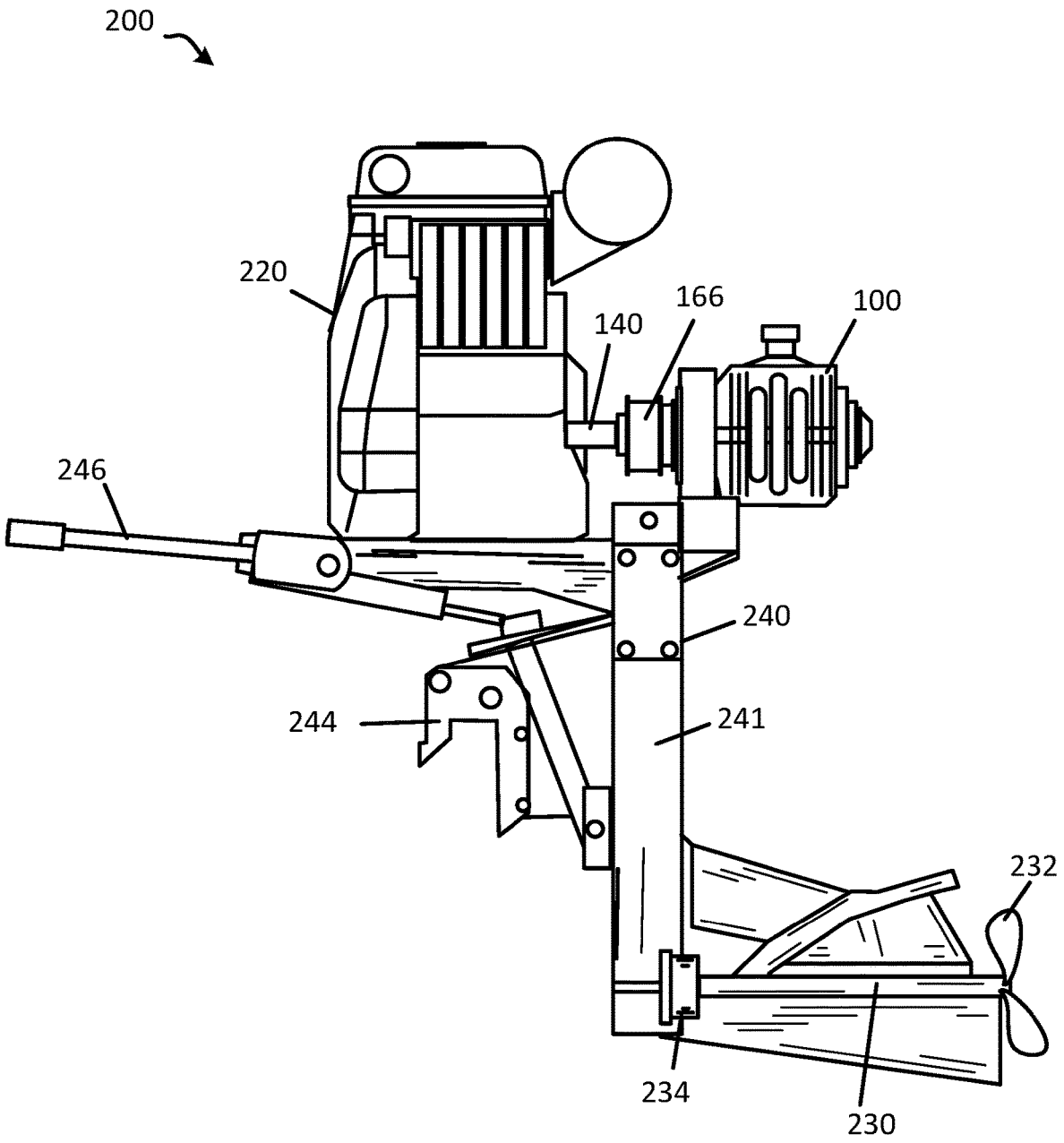
FIG. 9 illustrates a side view of an outboard marine propulsion system that includes a gearcase with coaxial input and output shafts, in accordance with an embodiment of the present disclosure.

FIG. 9 illustrates a side view of an outboard marine propulsion system 200 having a gearcase 100 with coaxial input and output shafts, in accordance with an embodiment of the present disclosure. Details of the gearcase 100 are discussed above with reference to FIGS. 1-7. The marine propulsion system 200 is configured for mounting to the transom of a boat and includes a combustion engine 220 operably connected to the input shaft 140 of the gearcase 100. The gearcase 100 and engine 220 are mounted to a frame 240 along with a transom mount 244 and a tiller handle 246 for controlling the throttle, steering, and propeller 232 height, for example. Here, the length of the propeller shaft 230 and ability to adjust the propeller 232 to operate just below water surface can make the propulsion system 200 suited for powering a mud boat. A drive belt 204 (shown in FIG. 7) extends through a vertical portion 241 of the frame 240 and connects the pulley 166 to the propeller shaft pulley 234 to turn the propeller shaft 230. Numerous other configurations and options can be implemented to suit a particular use, as will be appreciated.

Further Example Embodiments

The following examples pertain to further embodiments, from which numerous permutations and configurations will be apparent.

Example 1 is a gearcase for a marine propulsion system. The gearcase includes an input shaft rotatable about a central axis of rotation and an output shaft coaxially arranged with the input shaft. A clutch assembly is operable between a first clutch position and a second clutch position. When the clutch assembly is in the first clutch position, the input shaft is coupled to the output shaft for rotating the output shaft in a first rotational direction. A gear assembly operably connects the input shaft to the output shaft when the clutch assembly is in the second clutch position for rotating the output shaft in an opposite second rotational direction. The clutch assembly can include a neutral or idle position between the first clutch position and the second clutch position.

Example 2 includes the subject matter of Example 1, where the gear assembly comprises a first gear, a second gear, a third gear, a fourth gear, and a fifth gear. An idle shaft is parallel to the input shaft and includes the third gear on a first portion of the idle shaft and the fourth gear on a second portion of the idle shaft. When the clutch assembly is in the second clutch position, the first gear drives the idle shaft via the second gear, and the idle shaft drives the output shaft via the fifth gear.

Example 3 includes the subject matter of Example 2, wherein the idle shaft is vertically below the input shaft.

Example 4 includes the subject matter of Example 2 or 3, wherein the central axis of rotation is spaced from an axis of the idle shaft by a distance from 75-95 mm.

Example 5 includes the subject matter of any one of Examples 2-4, wherein the first gear and the fifth gear are coaxially arranged with the input shaft, and wherein the first gear engages the second gear and the fifth gear engages the fourth gear.

Example 6 includes the subject matter of Example 5, wherein the second gear rotates about an axis of rotation that is offset from the input shaft and from the idle shaft.

Example 7 includes the subject matter of any of Examples 1-6, and further comprises a pulley on the output shaft.

Example 8 includes the subject matter of any of Examples 1-7, wherein the gearcase has a gear ratio of 1.0 when the clutch is in the first clutch position. For example, the first clutch position corresponds to forward drive.

Example 9 includes the subject matter of any of Examples 1-8, wherein the gearcase has a gear ratio of 1.0 when the clutch is in the second clutch position. For example, the second clutch position corresponds to reverse drive.

Example 10 includes the subject matter of any of Examples 1-9, and includes a roller bearing between the input shaft and the output shaft. For example, the roller bearing is configured as a needle bearing.

Example 11 includes the subject matter of any of Examples 1-10, further comprising a roller bearing between the input shaft and the fifth gear. For example, the roller bearing is configured as a needle bearing.

Example 12 includes the subject matter of any of Examples 1-11, further comprising a roller bearing between the output shaft and a housing of the gearcase. For example, the roller bearing is configured as a double roller bearing.

Example 13 is a marine propulsion system comprising the gearcase of any of Examples 1-12. The marine propulsion system further comprises a propeller shaft, a drive belt coupling the pulley on the output shaft to the propeller shaft, and an engine or electric motor operatively coupled to the input shaft.

Example 14 includes the subject matter of Example 13, wherein the pulley is between the gearcase and the engine or electric motor.

Example 15 includes the subject matter of Example 13 or 14, where the marine propulsion system is an outboard boat motor configured for mounting to a boat transom.

Example 16 includes the subject matter of Examples 15 and further comprises a tiller handle.

Example 17 includes the subject matter of any of Examples 13-16, wherein the engine or electric motor has an output power from 50 horsepower to 100 horsepower.

Example 18 is a method of power transmission for a boat motor, the method comprising engaging a first clutch; transferring rotational power from an engine input shaft to an engine output shaft coaxially arranged with the input shaft, thereby rotating the output shaft in a first rotational direction; and transferring rotational power from the output shaft to a propeller shaft via a drive belt, the propeller shaft having a shaft axis generally parallel to the input shaft and vertically spaced from the input shaft.

Example 19 includes the subject matter of Example 18 and further comprises engaging a second clutch and coupling the input shaft to a gear assembly configured and arranged to operably connect the input shaft to the output shaft thereby rotating the output shaft in an opposite second rotational direction Example 20 includes the subject matter of Example 19, and further comprises coupling a first gear to the input shaft; engaging the first gear with a second gear; engaging the second gear with a third gear on a first portion of an idle shaft; engaging a fourth gear on a second portion of the idle shaft with a fifth gear coaxially arranged with the input shaft; and engaging the fifth gear with the output shaft to rotate the output shaft in an opposite second rotational direction.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A gearcase for a marine propulsion system, comprising:
an input shaft rotatable about a central axis of rotation;
an output shaft coaxially arranged with the input shaft such that the input shaft extends through the output shaft;
a clutch assembly operable between a first clutch position and a second clutch position, wherein, when the clutch assembly is in the first clutch position, the input shaft is coupled to the output shaft for rotating the output shaft in a first rotational direction; and
a gear assembly operably connecting the input shaft to the output shaft, wherein when the clutch assembly is in the second clutch position the gear assembly is arranged to rotate the output shaft in an opposite second rotational direction.

2. A gearcase for a marine propulsion system, comprising:
an input shaft extending through the gearcase and rotatable about a central axis of rotation;
an output shaft coaxially arranged with the input shaft;
a clutch assembly operable between a first clutch position and a second clutch position, wherein, when the clutch assembly is in the first clutch position, the input shaft is coupled to the output shaft for rotating the output shaft in a first rotational direction; and
a gear assembly operably connecting the input shaft to the output shaft when the clutch assembly is in the second clutch position for rotating the output shaft in an opposite second rotational direction, wherein the gear assembly comprises:
a first gear;
a second gear;
a third gear;
a fourth gear;
a fifth gear; and
an idle shaft parallel to the input shaft, the idle shaft including the third gear on a first portion of the idle shaft and the fourth gear on a second portion of the idle shaft;
wherein when the clutch assembly is in the second clutch position, the first gear drives the idle shaft via the second gear, and the idle shaft drives the output shaft via the fifth gear.

3. The gearcase of claim 2, wherein the idle shaft is vertically below the input shaft.

4. The gearcase of claim 3, wherein the central axis of rotation is spaced from an axis of the idle shaft by a distance from 75-95 mm.

5. The gearcase of claim 2, wherein the first gear and the fifth gear are coaxially arranged with the input shaft, and wherein the first gear engages the second gear and the fifth gear engages the fourth gear.

6. The gearcase of claim 5, wherein the second gear rotates about an axis of rotation that is offset from the input shaft and the idle shaft.

7. The gearcase of claim 1, further comprising a pulley on the output shaft.

8. The gearcase of claim 1, wherein the gearcase has a gear ratio of 1.0 when the clutch assembly is in the first clutch position.

9. The gearcase of claim 8, wherein the gearcase has a gear ratio of 1.0 when the clutch assembly is in the second clutch position.

10. The gearcase of claim 1, further comprising a roller bearing between the input shaft and the output shaft.

11. The gearcase of claim 2, further comprising a roller bearing between the input shaft and the fifth gear.

12. The gearcase of claim 1, further comprising a roller bearing between the output shaft and a housing of the gearcase.

13. A marine propulsion system comprising the gearcase of claim 7 and further comprising:

a propeller shaft;

a drive belt coupling the pulley on the output shaft to the propeller shaft; and an engine or electric motor operatively coupled to the input shaft.

14. The marine propulsion system of claim 13, wherein the pulley is between the gearcase and the engine or electric motor.

15. The marine propulsion system of claim 14 configured as an outboard boat motor configured for mounting to a boat transom.

16. The marine propulsion system of claim 15, further comprising a tiller handle.

17. The marine propulsion system of claim 14, wherein the engine or electric motor has an output power from 50 horsepower to 100 horsepower.

18. A method of power transmission for an outboard boat motor, comprising:

engaging a first clutch;

transferring rotational power from an input shaft to an output shaft coaxially arranged along a central axis with the input shaft and wherein the input shaft extends through the output shaft, thereby rotating the output shaft in a first rotational direction; and transferring rotational power from the output shaft to a propeller shaft via a drive belt, the propeller shaft having a shaft axis generally parallel to the input shaft and vertically spaced below the input shaft.

19. The method of claim 18, further comprising:

engaging a second clutch;

coupling the input shaft to a gear assembly configured and arranged to operably connect the input shaft to the output shaft thereby rotating the output shaft in an opposite second rotational direction.

20. The method of claim 18, further comprising:

coupling a first gear to the input shaft;

engaging the first gear with a second gear;

engaging the second gear with a third gear on a first portion of an idle shaft;

engaging a fourth gear on a second portion of the idle shaft with a fifth gear coaxially arranged with the input shaft; and engaging the fifth gear with the output shaft to rotate the output shaft in an opposite second rotational direction.

* * * * *